United States Patent [19]

Sears et al.

[11] 4,019,853

[45] Apr. 26, 1977

[54] AUTOMATIC FUEL IGNITION APPARATUS

[75] Inventors: Arthur H. Sears, Youngstown; August J. Siuta, Jr., Lockport, both of N.Y.

[73] Assignee: The Carborundum Company, Niagara Falls, N.Y.

[22] Filed: Nov. 3, 1975

[21] Appl. No.: 628,300

[52] U.S. Cl. ..... 431/67; 251/129

[51] Int. Cl.[2] ..... F23N 5/00

[58] Field of Search ..... 431/67, 73, 77, 78; 251/129; 60/DIG. 2

[56] References Cited

UNITED STATES PATENTS

| | | | |
|---|---|---|---|
| 2,542,666 | 2/1951 | Hall | 431/78 X |
| 2,954,080 | 9/1960 | Prouty et al. | 431/67 X |
| 3,153,440 | 10/1964 | Baumanns | 431/67 |
| 3,778,218 | 12/1973 | Wright etal. | 431/67 |

*Primary Examiner*—Edgar W. Geoghegan
*Attorney, Agent, or Firm*—David E. Dougherty; Raymond W. Green; Michael L. Dunn

[57] ABSTRACT

An apparatus for fluid fuel ignition which consists essentially of an igniter which reaches a temperature above the ignition temperature of the fuel when sufficient electricity from an electrical source passes through the igniter and which igniter remains continuously at a temperature above the ignition temperature of the fuel while the fuel passes through a fuel injection means proximate to the igniter. A thermal delay relay which activates a valve, which permits fuel to pass through the fuel injection means proximate the igniter, is responsive to current flow through the igniter after the igniter has reached ignition temperature. The apparatus requires no mechanical moving parts other than a thermostat, one electrical relay and a fuel valve responsive to an electrical signal. Only two sets of electrical contacts are required in the entire apparatus including the thermostat and internal relay contacts. The apparatus may be conveniently designed to operate at either low or high voltage. A low voltage thermostatic control may optionally be used in conjunction with a high voltage ignition which requires only one additional relay.

16 Claims, 3 Drawing Figures

AUTOMATIC FUEL IGNITION APPARATUS

BACKGROUND OF THE INVENTION

This invention concerns a fuel ignition apparatus which safely controls the passage of fuel to a fuel igniter.

In the prior art apparatus for safely controlling the flow of fuel to an igniter were known; however, prior art apparatus had serious disadvantages. The first such apparatus were not electrically controlled but were devices subject to mechanical failure. The first such apparatus employing electric igniters were designed to permit the current to stop flowing through the igniter after commencement of combustion of the fuel. In such apparatus, means for stopping flow of current through the electrical igniters were necessary to prevent the igniter from rapidly burning out. In addition, complex apparatus was required to shut off the flow of fuel from a fuel source in the event that combustion accidentally ceased.

Improved electrical igniters were subsequently developed which permitted continuous flow of current through the igniter during the entire period that fuel flowed from the fuel source. Prior art apparatus employing such continuously operated igniters utilized complex electrical and mechanical devices to shut off the flow of fuel in the event that the igniter ceased to function. Apparatus which does not incorporate a device or system for stopping flow of fuel from the fuel source when the igniter ceases to function is not considered safe since in the event that combustion accidentally ceases, unburned fuel would continue to flow from the fuel source thus presenting an explosion and toxicity hazard.

SUMMARY OF THE INVENTION

The present invention provides apparatus for automatic fluid fuel ignition, comprising: (a) an electrical resistance igniter means for igniting fluid fuel; (b) fluid fuel supply means comprising a normally closed fluid fuel valve; (c) fluid fuel flow means for flowing the fuel proximate the igniter means when the fluid fuel valve is open; and (d) valve opening means comprising a time delay relay, electrically connected in series to the igniter means, for opening the fluid fuel valve after the igniter means is at a temperature above the ignition temperature of the fluid fuel.

The apparatus of the present invention is simple in design, utilizes few mechanical parts, yet safely stops the flow of fuel from the fuel source in the event that the igniter ceases to function. The apparatus for automatic fuel ignition in accordance with the present invention consists essentially of an igniter which reaches a temperature above the ignition temperature of the fuel to be ignited when sufficient electricity from the electrical source passes through the igniter. A time delay relay is provided which is connected to the electrical source in series with the igniter. The time delay relay contains a normally open set of electrical contacts which are closed after a time delay when the relay is activated by an electrical current which flows from the electrical source through the relay and igniter. To activate the relay the electrical current must be sufficient to heat the igniter to a temperature above the ignition temperature of the fuel. A primary control means, such as a thermostat, a manual switch, or relay activated switch is provided, which has a set of electrical contacts connected to the electrical source in series with the igniter and time delay relay. The primary control means causes an electrical current from the electrical source to flow through the igniter and time delay relay when the contacts in the primary control means are closed. A normally closed fuel valve connected between a fuel supply and a fuel injection means is also provided. The valve is electrically connected in series with the contacts in the time delay relay to the electrical source and is electrically activated to its open position when the contacts in the time delay relay are closed. The fuel injection means is positioned to permit fuel passing through the fuel injection means from the fuel supply to pass close enough to the igniter to cause the fuel to ignite.

Should the igniter cease to function, which can only happen if current ceases to flow through the igniter circuit, i.e., by failure of the electrical source or by a gap in the igniter such as would be caused by igniter burnout, the time delay relay would be deactivated since the activation of the time delay relay is dependent upon the flow of current through the igniter circuit. When the time delay relay is deactivated, the contacts in the relay open, thus stopping the flow of electric current to the fuel valve which then closes to stop the flow of fuel from the fuel source. It is therefore clear that the igniter must be in operation to permit the fuel to flow from the fuel source. In addition, while the igniter is in operation, combustion of fuel from the fuel source will not stop since the continuously operated igniter will cause fuel passing from the fuel source to burn even after the occurrence of a temporary condition which might otherwise stop combustion. Such a temporary condition might for example be an interruption in fuel flow from the fuel source. The continuously operated igniter will not permit the hazardous collection of unburned fuel since the instant that unburned fuel contacts the igniter, combustion of the fuel will again commence.

DETAILED DESCRIPTION OF THE INVENTION

Figure 1:
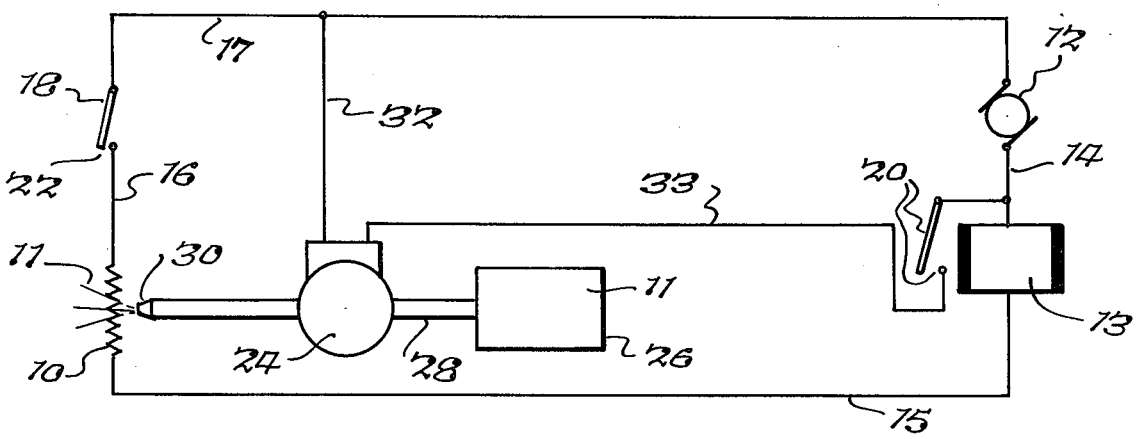
FIG. 1 is a schematic diagram of the apparatus of the invention wherein all components of the invention operate from a single electrical source.

The electrical source may be a high voltage electrical source, i.e., between about 75 and about 600 volts, or may be a low voltage electrical source, i.e., between about 6 and 75 volts. In addition, the apparatus of the invention may operate upon a combination of both high and low voltage electrical sources. The electrical source may be an alternating current electrical source, e.g., 60 cycles per second, or may be a direct current electrical source. When both high and low voltage electrical sources are used they may be either independent or interdependent. For example, the high voltage electrical source may be commercially supplied electrical power or may be a battery of a large number, i.e., over 50, of direct current cells. The low voltage electrical source may be either a low voltage direct current electrical source such as would be supplied by a battery of a smaller number of direct current cells, i.e., from about four to about 50 cells, or may be obtained from a transformer which steps down the voltage from the high voltage electrical source. When a combination of high and low voltage electrical sources is used, in general the high voltage electrical source is used in the igniter circuit and the low voltage electrical source is used to operate the remaining elements of the circuit, that is, the primary control means and fuel valve.

The electrical source which operates the apparatus whether it is a high voltage electrical source, a low voltage electrical source or a combination of high and low voltage electrical sources, is usually an alternating current. The electrical source may, however, be a direct current when there are no components in the apparatus, such as a transformer, which depend upon electrical induction for operation.

The igniter, which reaches a temperature above the ignition temperature of the fuel when sufficient electricity from the electrical source passes through the igniter, is an electrical resistance, preferably of silicon carbide, which converts a large portion of the electricity passing through the resistance to heat. Furthermore, the igniter is capable of continuous operation without burning up due to its self-generated heat. The igniter and the source connected with the igniter must be matched so that sufficient current passes through the igniter to generate a temperature above the ignition temperature of the fuel and so that insufficient current passes through the igniter to cause the igniter to melt or burn thus creating an electrical gap in the igniter circuit. Suitable igniters are known, for example, from U.S. Pat. No. 3,372,305 and U.S. applications Ser. Nos. 435,352, filed Jan. 21, 1974 and 477,707, filed June 10, 1974 now abandoned.

The fuel for use in conjunction with the apparatus of the invention may be any suitable combustible fluid such as fuel oil, kerosene, alcohol, propane, butane, coal gas, gasoline, natural gas, and acetylene.

The time delay relay connected with the electrical source in series with the igniter may be any suitable electrically activated time delay relay. In general, the time delay relay preferred for use in conjunction with the apparatus of the invention comprises an electrical resistance which becomes heated upon the passage of sufficient electrical current through the electrical resistance and a bimetallic strip which becomes heated by the heat generated by the electrical resistance. The electrical resistance of the relay does not begin to heat up substantially until the igniter is heated, however, due to the series connection of the igniter and the relay. The current first flows through the cold igniter and relay in smaller amounts, until the igniter becomes heated (by the flow of current) sufficiently to lower its resistance and thereby further allow the current flow to increase. After the igniter is thus heated and the current flow raised, greater quantities of current flow through the electrical resistance of the relay, generating heat which causes the bimetallic strip to bend.

As the bimetallic strip bends, a set of electrical contacts in the time delay relay is closed. This second time delay (the first being the time necessary to build up sufficient current in the igniter to lower its resistance) results from the time lag required for the electrical resistance in the relay to become heated, for the heat to be transferred to the bimetallic strip and for the bimetallic strip to bend to close the contacts. In accordance with the preferred embodiment of the invention, the electrical resistance which heats the bimetallic strip is connected in series with the igniter in the igniter circuit and is electrically compatible with the electrical current flowing through the igniter circuit so that the resistance becomes sufficiently heated to cause bending of the metallic strip, but does not become overheated so as to cause the electrical resistance in the time delay relay to melt or burn.

The primary control means having a set of electrical contacts connected to the electrical source in series with the igniter and time delay relay is any suitable primary control means such as a manually operated switch, a thermostat, an automatically operated electrical switch, or a combination of these such as a manual switch plus a thermostat, as for example in a gas oven. When the primary control means is an automatically operated electrical switch, it preferably is automatically operated by an electrical current which may originate from either a high or low voltage electrical source. When an electrical current is used to operate the primary control means, it may be a high voltage electrical current, but is preferably a low voltage electrical current thus eliminating high voltage hazards. In the preferred embodiment of the invention, the primary control means comprises a set of electrical contacts which are controlled by a relay coil which closes the contacts when the relay coil is activated by a low voltage electrical source. In accordance with the preferred embodiment of the invention, a thermostat is preferably connected in series with the relay coil to the low voltage electrical source. When the temperature surrounding the thermostat drops sufficiently, the thermostat contacts will close thus activating the relay coil which in turn closes the electrical contacts which are in series in the igniter circuit. When the electrical contacts in the igniter circuit are closed, the igniter circuit is complete, thus causing the igniter to become heated to a temperature above the ignition temperature of the fuel. The low voltage electrical source which activates the relay coil is preferably the secondary of a step-down transformer having its primary connected with a high voltage electrical source which is the same as the electrical source connected with the igniter.

The normally closed fuel valve connected between a fuel supply and a fuel injection means is any suitable valve which can be electrically activated by the electrical source to which it is connected. The normally closed fuel valve is generally a solenoid valve which has a solenoid coil connected to the activating electrical source in series with the contacts in the time delay relay. The fuel valve is electrically activated to its open position when the contacts in the time delay relay are closed. The "normal" mode is when the igniter is cold and fuel is not flowing.

The fuel injection means is positioned to permit fuel passing through the fuel injection means to pass close enough to the igniter to cause the fuel to ignite and is generally any suitable orifice in or at the end of a fuel conduit. Suitable fuel injection means include nozzles and fuel burners having a series of orifices.

The fuel supply which the fuel valve is connected is any suitable fuel supply and may be a commercial gas line or a fuel container such as a low pressure gas cylinder or an oil tank.

The normally closed fuel valve can be operated by either a high or low voltage electrical source. The fuel valve is however, preferably operated by a low voltage electrical source to eliminate high voltage hazards. The low voltage electrical source is preferably the secondary of a step-down transformer having its primary connected with a high voltage electrical source which is the same as the electrical source connected to the igniter.

When the switch or electrical contacts in series with the igniter are controlled by a relay coil activated by a low voltage electrical source and when the normally closed fuel valve is activated by a low voltage electrical source, the low voltage electrical source for both the relay coil and the normally closed fuel valve may be the same.

In operation the set of electrical contact in the primary control means become closed either manually or automatically. Since the electrical contacts of the primary control means are connected to an electrical source in series with the igniter and time delay relay, the closing of the primary control electrical contacts causes an electrical current from the connected electrical source to flow through the igniter and time delay relay. The flow of the electrical current through the igniter soon causes the igniter to reach a temperature above the ignition temperature of the fuel and the flow of the electrical current through the time delay relay closes a normally open set of electrical contacts in the time delay relay after a time delay.

Since the electrical contacts in the time delay relay are connected to an electrical source in series with an activating coil in a normally closed fuel valve, the closing of the contacts in the time delay relay results in the flow of an electrical current from an electrical source through the activating coil in the normally closed fuel valve thus opening the fuel valve to permit fuel to flow proximate the igniter. The heat of the igniter then causes the fuel to ignite.

If at any time the flow of fuel to the igniter becomes interrupted, thus causing combustion to cease, the igniter will stay heated and will re-ignite the fuel when fuel flow again commences. The continuously operating igniter therefore prevents the hazardous collection of unburned fuel.

If at any time, for any reason, the igniter circuit fails, for example by burnout of the igniter, the time delay relay will become rapidly deactivated, due to the discontinuance of flow of electricity through the relay, thus in turn deactivating the fuel valve which will return to the closed position to cut off fuel flow.

It is therefore clear that the apparatus of the invention is an apparatus for automatic fuel ignition which overcomes the disadvantages of prior art fluid fuel ignition apparatus since the apparatus of the invention is safe, simple and reliable.

Referring now to the drawings as best seen in FIG. 1 of the invention, in its simplest form, the automatic fuel ignition apparatus of the invention consists essentially of an igniter 10, which in general is an electrical resistance, which reaches a temperature above the ignition temperature of fuel 11 when sufficient electricity from electrical sources 12 passes through igniter 10.

A time delay relay 13 is connected with the electrical source 12 by means of electrical conductors 14, 15, 16 and 17. The time delay relay is connected to the electrical source in series with igniter 10 and a primary control means 18. Time delay relay 13 contains a normally open set of electrical contacts 20 which are closed after a time delay when relay 13 is activated by an electrical current which flows from electrical source 12 through relay 13 and igniter 10.

The primary control means 18 has a set of electrical contacts 22 connected to electrical source 12 in series with igniter 10 and time delay relay 13 by means of electrical conductors 14, 15, 16 and 17. The primary control means causes an electrical current from electrical source 12 to flow through the igniter 10 and time delay relay 13 when contacts 22 in the primary control means 18 are closed. A normally closed fuel valve 24 is connected between a fuel supply 26 by means of conduit 28 and a fuel injection means 30.

Fuel valve 24 is electrically connected by means of electrical conductors 14, 17, 32 and 33 to electrical source 12 in series with electrical contacts 20 in time delay relay 13. Fuel valve 24 is electrically activated to an open position when contacts 20 in time delay relay 13 are closed. Fuel injection means 30 is positioned to permit fuel 11 passing through fuel injection means 30 to pass close enough to igniter 10 to cause the passing fuel to ignite. Primary control means 18 as shown in FIG. 1, may be any suitable electrical switch mechanism such as a thermostat or a manually operated switch.

In operation, electrical contacts 22 become closed thus permitting an electrical current from electrical source 12 to flow through igniter 10, time delay relay 13 and electrical conductors 14, 15, 16 and 17. The flow of electrical current through igniter 10 soon causes igniter 10 to reach a temperature above the ignition temperature of fuel 11.

The flow of electrical current through time delay relay 13 causes electrical contacts 20 to become closed after a time delay. When electrical contacts 20 become closed, fuel valve 24 which is electrically connected by means of electrical conductors 14, 17, 32 and 33, to electrical source 12 in series with electrical contacts 20, becomes electrically activated to an open position thus causing fuel 11 to flow from fuel supply 26 through valve 24 through fuel injection means 30 to igniter 10 which causes fuel 11 to ignite. The flow of electrical current through igniter 10 is continuous thus igniter 10 is continuously at a temperature above the ignition temperature of fuel 11. An interruption in the flow of fuel 11 to igniter 10 will stop ignition. However, the hazardous collection of fuel 11 will not be permitted since when the flow of fuel again resumes, igniter 10 will re-ignite the fuel. If at any time the flow of electrical current through igniter 10 stops, for example by burnout of igniter 10, time delay relay 13 will become deactivated thus opening electrical contacts 20 which will cause fuel valve 24 to close thus shutting off the flow of fuel to fuel injection means 30.

Figure 2:
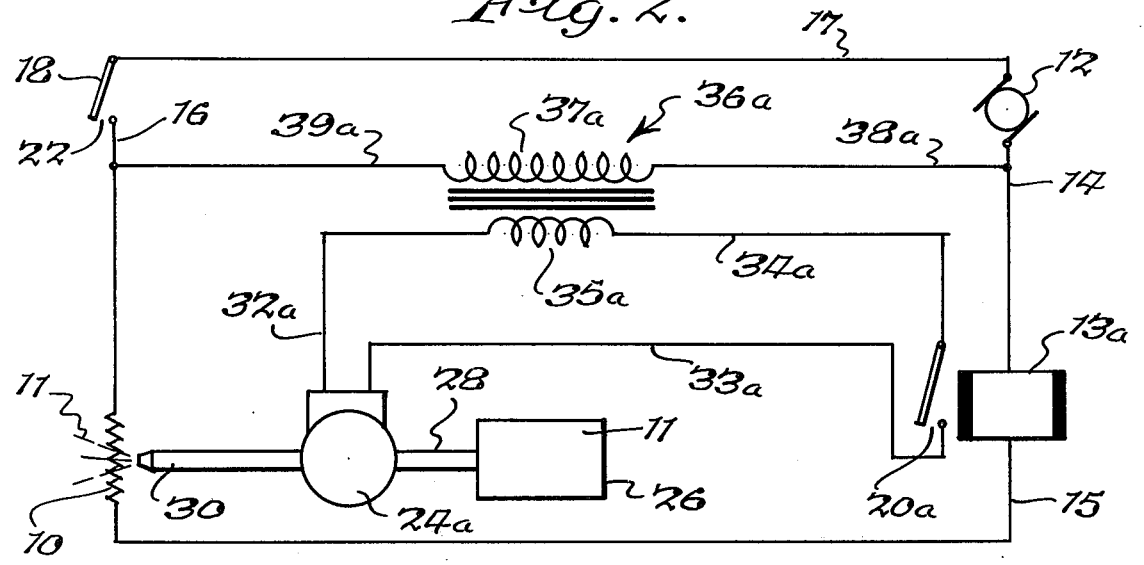
FIG. 2 is a schematic diagram of an alternative embodiment of the apparatus of the invention wherein the fuel valve is operated by a low voltage electrical source and the igniter is operated by a high voltage electrical source.

FIG. 2 shows an alternative embodiment of the invention which operates in essentially the same manner as the embodiment shown in FIG. 1 except that fuel valve **24*a* operates on low rather than high voltage and is electrically connected by means of conductors 32*a*, 33*a* and 34*a* to a low voltage source 35*a* in series with contacts 20*a* of time delay relay 13*a***.

Low voltage source **35*a* is the secondary of step-down transformer 36*a* which has its primary 37*a* electrically connected by means of electrical conductors 38*a*, 14, 17, 16 and 39*a* to electrical source 12 in series with primary control means 18 in such a way that when electrical contacts 22 in primary control means 18 are closed, the primary 37***a* of transformer 36*a* is activated thus activating secondary 35*a* of transformer 36*a*.

Figure 3:
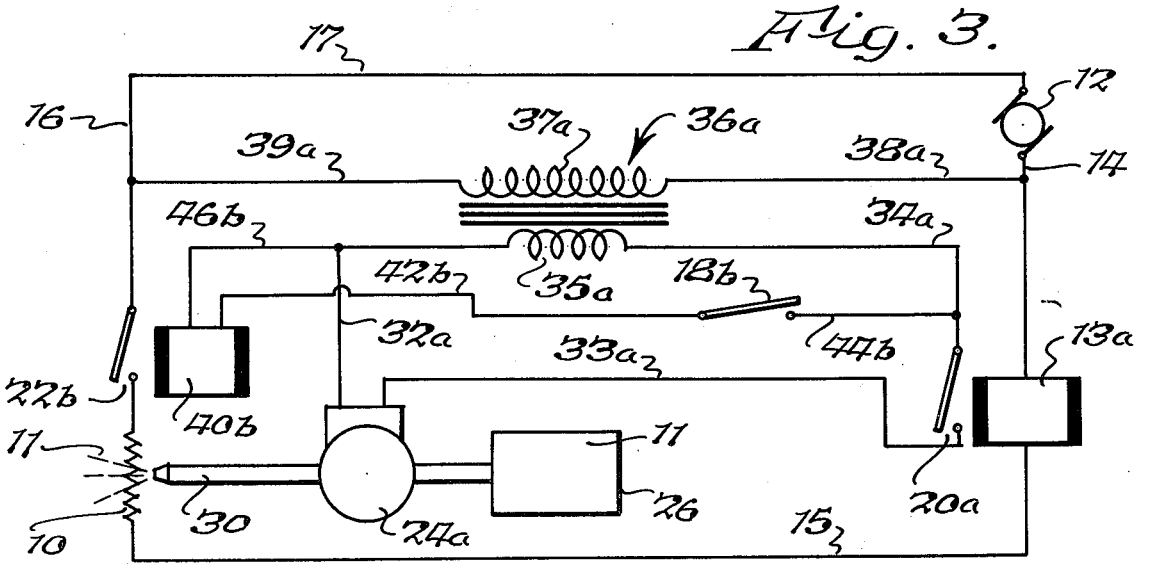
FIG. 3 is a schematic diagram of a second alternative embodiment of the invention wherein both the primary control means and fuel valve are operated by a low voltage electrical source and the igniter is operated by a high voltage electrical source.

FIG. 3 shows a second alternative embodiment of the invention which operates in essentially the same way as the apparatus shown in FIG. 2 except that the primary control means comprises a set of electrical contacts 22*b* which are controlled by a relay coil 40*b* which closes contacts 22*b* when relay coil 40*b* is activated by low voltage source 35*a*. Low voltage source 35*a* is connected with relay coil 40*b* by means of electrical conductors 42*b*, 44*b*, 34*a* and 46*b*. A primary control switch 18*b* is connected in series with relay 40*b* to low voltage source 35*a*. Primary control switch 18*b* may be a thermostat or a manually operated switch.

What is claimed is:

1. Apparatus for automatic fluid fuel ignition, comprising:

a. an electrical resistance igniter means for igniting fluid fuel;

b. fluid fuel supply means including a normally closed fluid fuel valve;

c. fluid fuel flow means for flowing the fuel proximate the igniter means when the fluid fuel valve is open; and d. valve opening means comprising an electrically activated time delay relay, electrically connected in series to the igniter means, for opening the fluid fuel valve, sufficient electrical current to activate said relay passing through said relay only after the igniter means is at a temperature above the ignition temperature of the fluid fuel.

2. The apparatus as claimed in claim 1, wherein the time delay relay contains a normally open set of electrical contacts which are closable after time delay, responsive to electrical current passing through the relay.

3. The apparatus as claimed in claim 2, comprising in addition primary control means for causing electric current to flow through the igniter means and through the time delay relay.

4. The apparatus as claimed in claim 3, wherein the igniter means, time delay relay and primary control means are electrically connected in series.

5. The apparatus as claimed in claim 4, wherein the igniter means, time delay relay and primary control means are also electrically connected in series to an electrical source.

6. An apparatus for automatic fuel ignition consisting essentially of:

a. an igniter which reaches a temperature above the ignition temperature of the fuel when sufficient electrical current from an electrical source passes through the igniter;

b. a time delay relay connected with the electrical source in series with the igniter, said time delay relay containing a normally open set of electrical contacts which are closed after a time delay when the relay is activated by an electrical current which flows from the electrical source through the relay and igniter, said electrical current being sufficient to activate said relay only after the igniter reaches a temperature above the ignition temperature of the fuel;

c. a primary control means having a set of electrical contacts connected to the electrical source in series with the igniter and time delay relay, said primary control means causing said electrical current from the electrical source to flow through the igniter and time delay relay when said contacts in the primary control means are closed; and d. a normally closed fuel valve connected between a fuel supply and a fuel injection means, said valve being electrically connected to an electrical source in series with the contacts in the time delay relay, said fuel valve being electrically activated to its open position when the contacts in the time delay relay are closed, said fuel injection means being positioned to permit fuel passing through said fuel injection means to pass close enough to the igniter to cause said fuel to ignite.

7. The apparatus as claimed in claim 6 wherein the electrical source to which the igniter and time delay relay are connected in series is a high voltage electrical source.

8. The apparatus as claimed in claim 7 wherein the primary control means is a thermostat.

9. The apparatus as claimed in claim 8 wherein the electrical source connected to the valve is a low voltage electrical source.

10. The apparatus as claimed in claim 8 wherein the electrical source connected to the valve is a high voltage electrical source connected with the igniter.

11. The apparatus as claimed in claim 9 wherein the electrical source connected to the valve is the secondary of a step-down transformer having its primary connected with a high voltage electrical source which is the same as the electrical source connected with the igniter.

12. The apparatus as claimed in claim 11 wherein the thermostat is connected in series with the high voltage electrical source and the primary of the transformer.

13. The apparatus as claimed in claim 7 wherein the electrical contacts in the primary control means are controlled by a relay coil which closes the contacts in the primary control means when the relay coil is activated by a low voltage electrical source.

14. The apparatus as claimed in claim 13 wherein a thermostat is connected in series with the relay coil to the low voltage electrical source.

15. The apparatus as claimed in claim 14 wherein the electrical source connected to the relay coil is the secondary of a step-down transformer having its primary connected with a high voltage electrical source which is the same as the electrical source connected with the igniter.

16. The apparatus as claimed in claim 15 wherein electrical source connected to the valve is a low voltage electrical source and is the same low voltage electrical source which is connected to the relay coil.

* * * * *